United States Patent [19]

Roy et al.

[11] 4,217,567

[45] Aug. 12, 1980

[54] TUBULAR SOLENOID

[75] Inventors: Kenneth L. Roy, Centerville; William D. Sadgebury, New Carlisle, both of Ohio

[73] Assignee: Ledex, Inc., Vandalia, Ohio

[21] Appl. No.: 943,110

[22] Filed: Sep. 18, 1978

[51] Int. Cl.[2] ..... H01F 3/00; H01F 7/08

[52] U.S. Cl. ..... 335/255; 335/262; 335/278

[58] Field of Search ..... 335/255, 257, 258, 260, 335/262, 278, 281, 282

[56] References Cited

U.S. PATENT DOCUMENTS

| | | | |
|---|---|---|---|
| 3,249,823 | 5/1966 | Beardow | 335/260 X |
| 3,303,445 | 2/1967 | Flentge | 335/255 |
| 3,400,351 | 9/1968 | Flentge | 335/257 |
| 3,597,715 | 8/1971 | Davis | 335/278 X |
| 3,921,111 | 11/1975 | Kowalski | 335/262 X |
| 4,041,430 | 8/1977 | Hrynewycz | 335/278 X |

FOREIGN PATENT DOCUMENTS

| | | | |
|---|---|---|---|
| 1141932 | 2/1969 | United Kingdom | 335/262 |

*Primary Examiner*—Fred L. Braun

*Attorney, Agent, or Firm*—Biebel, French & Nauman

[57] ABSTRACT

Low cost tubular solenoids are formed with a drawn case in which the pole portion forming the base of the solenoid is defined as an integral inwardly extending part of the case. A coil bobbin is formed by the injection molding of plastic material and is provided with an integral wall which is positioned in abutting relation to the inside surface of the pole portion, thereby forming a stop surface for the solenoid plunger and effectively spacing the plunger from the base. The plunger is guided on the internal surfaces of the bobbin and in one embodiment, a spun hollow sheet metal bushing is captured by the case in telescopic relation to the bobbin, and is formed with threads which receive thereon a sheet metal retaining nut. In another embodiment of the invention, a washer is threaded onto an axial extension portion of the bobbin, and the open end of the case is crimped onto an annular groove formed on the washer. In a further embodiment, the washer is injected molded in place on the bobbin. Terminal leads are molded on the bobbin and extend through apertures formed in a bobbin extension elimating the need for the placement of coil lead-in wires.

9 Claims, 11 Drawing Figures

TUBULAR SOLENOID

BACKGROUND OF THE INVENTION

This invention is directed to tubular solenoids and more particularly to constructions for such solenoids which are less expensive to manufacture than tubular solenoids heretofore manufactured.

In many instances it is desirable to employ tubular solenoids for linear actuation. These units are generally manufactured at relatively low cost and are compact in size. However, to be successful in the market place these units must compete with open frame types of solenoids and this has, in the past been difficult, if not impossible, due to the particular construction employed, which requires the use of higher priced components and more expensive manufacturing techniques.

SUMMARY OF THE INVENTION

The present invention is directed to the design of low-cost tubular solenoids in which one of the poles or the base of the solenoid is formed as an integral part of a drawn case. The gap between the plunger and the base is maintained by a thin layer of polymer material forming an integral part of the spool or bobbin on which the coil is mounted. In addition, a forward extension portion of the bobbin, in one embodiment, provides the means by which the solenoid may be mounted or attached, and also provides the means by which a magnetic washer may be retained to complete the flux path between the case and the plunger.

As a further cost-saving feature, as well as enhancing reliability, a pair of lead-through terminals are molded or inserted into the bobbin and complete the electric path between the coil and the energizing source.

It is accordingly an important object of the invention to provide a low-cost tubular solenoid employing a drawn case which is closed at one end and in which the pole or the base of the solenoid is formed as an integral part of the case.

A further object of the invention is to provide a tubular solenoid employing a drawn case and having a portion associated with the open end of the case providing a return flux path to the plunger.

A still further object of the invention is to provide a tubular solenoid, as outlined above, incorporating a low cost threaded attachment which may, in one embodiment, be formed as an integral portion of the bobbin and in another embodiment be formed as a spun sheet metal element captured in telescopic relation to a forward cylindrical bobbin extension.

These and other objects and advantages of the invention will be apparent from the following description, the accompany drawings and the appended claims.

DETAILED DESCRIPTION OF THE PRIOR ART

Figure 1:
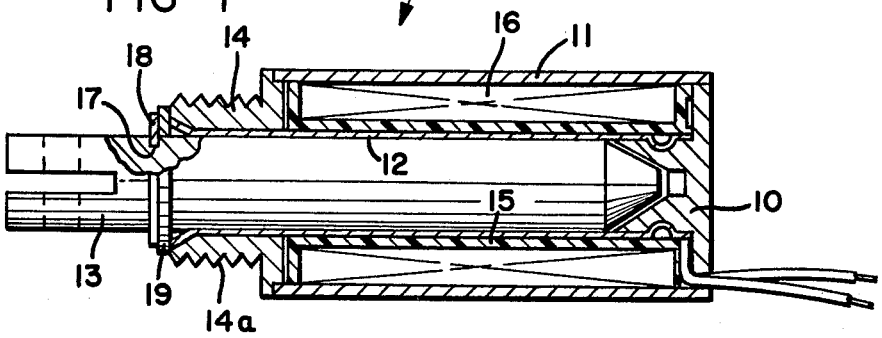
PRIOR ART FIG-1
FIG. 1 is a sectional view through a tubular solenoid constructed according to the prior art.

In FIG. 1 there is illustrated a solenoid constructed according to the prior art in which a machined pole or base 10 is received within a sleeve-like tubular case 11 and thus forms one pole of the solenoid. A nonferrous internal guide sleeve 12 has one end swaged or otherwise suitably connected to the base and forms an inside guiding surface for a plunger 13. The magnetic return path is completed by a machine threaded end cap 14 which is received at the other end of the case 11. A plastic bobbin 15 supporting an electric coil 16 is received on the inner sleeve 12 between the end cap 14 and the base 10. The plunger 13 is provided with a groove 17 for receiving a snap-ring 18. The snap ring provides a shoulder defining the position of a nonmetallic spacer ring 19, and in the actuated position of the solenoid, a spacer ring 19 prevents the nose of the plunger from coming into direct contact with the conical recess formed in the base 10, thereby assuring a working air gap.

In the manufacture of the tubular solenoid as shown in FIG. 1, control of the tolerances of the various parts must be accurately maintained so that the plunger 13 does not come into physical or direct contact with the base when the solenoid is energized, to maintain an air gap as shown. In addition, both the base and end cap must be separately machined and fitted within the case or sleeve 11. Mounting threads **14*a* are suitably rolled or cut on the outer surface of the end cap 14. The coil 16 is provided with conventional leads which are carried out through a slot or opening formed in the radial wall of the base 10**.

DESCRIPTION OF PREFERRED EMBODIMENTS

Figure 2:
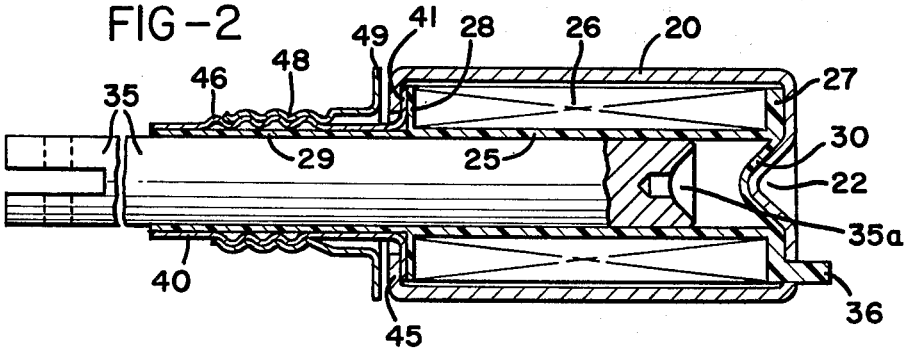
FIG. 2 is a sectional view through one embodiment of the solenoid of this invention.

Referring first to FIG. 2, an improved tubular solenoid according to this invention is shown in FIG. 2 as including a drawn cylindrical case 20 formed of ferrous or suitable flux-carrying magnetic material. The case is formed with an open end and a closed end. The closed end of the case 20 is formed with an inwardly extending pole portion 22.

A plastic bobbin 25 is received within the case and has an energizing coil 26 wound thereon between the radial end walls 27 and 28 of the bobbin 25. The bobbin 25 has an integral extension portion 29 which extends forwardly of the solenoid through an open end of the case 20. The bobbin also has means defining an integral, relatively thin rear spacer wall 30 which is positioned in conforming and abutting relation with the indented or inwardly-extending pole portion 22 of the case 20.

The bobbin 25 and the forward extension portion 29 defines an axial cylindrical opening for slidably receiving a plunger 35, also formed of suitable magnetic material. The plunger 35 has an inner conically recessed end 35*a* which is movable, when the solenoid is energized, into abutting and conforming relation with the integral spacer wall 30. The spacer wall 30 thereby forms a stop surface of the plunger 35, thus accurately spacing the plunger 35 from direct contact with the pole portion 22.

The rear wall of the case 20 is apertured to receive an integral terminal extension portion 36 of the bobbin 25 which supports a pair of terminals as will be described more fully in connection with FIGS. 5–8. The forward extension portion 29 of the bobbin 25 supports a generally tubular sheet metal bushing 40 on its outer surface. The bushing 40 has a flanged inner end 41 received in abutment with the forward bobbin wall 28 and captured therein by inwardly rolled or turned end 45 on the forward end of the case 20. The axial portion of the bushing 40 has formed thereon rolled threads 46 for receiving a sheet metal nut 48 thereover. The nut or retainer 48 is also provided with a flanged inner end 49, and is provided with complementary rolled threads and is threaded onto the bushing 40 to retain the solenoid in place on a suitable panel or the like. The bushing 40 may be formed of a suitable magnetic or flux-carrying ferrous material and is magnetically coupled to the case at its flange 41 to the inwardly turned case end 45 and forms a magnetic flux path to the plunger 35. The retainer nut 48 may be made of either magnetic or non-magnetic material, as desired.

The solenoid of this invention offers a number of important cost advantages over that of the prior art as illustrated in FIG. 1. The drawn metal case 20 is formed with an integral pole portion 22, thus eliminating the need for a separate base or pole piece as shown in FIG. 1. The injection molded coil form 25 provides integral means for spacing the plunger 35 from the pole portion 22, thus eliminating the need for accurately forming a snap ring groove in the plunger to support a snap ring and plunger stopper or spacer 19 of the prior art. The thickness of the wall 30 is the only tolerance variation in the effective air gap, as compared to the possibility of multiple tolerance build-up causing variations in the air gap of the prior art units. In addition, the retainer bushing 40 with the rolled threads thereon provides a substantial savings over the threaded end cap employed in the prior art. Further, the bobbin 25 provides the internal guide surfaces for the plunger 35, thus eliminating the need for a separate tubular non-magnetic sleeve 12 as employed in the prior solenoid of FIG. 1.

Figure 3:
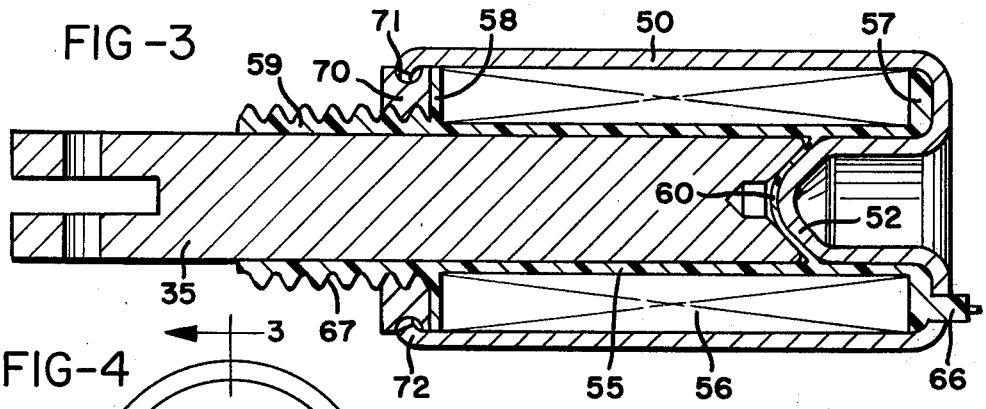
FIG. 3 is a somewhat enlarged sectional view through a modified form of the solenoid of this invention, taken generally along the line 3—3 of FIG. 4.
Figure 4:
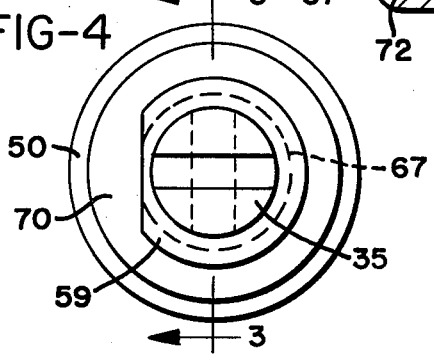
FIG. 4 is an end view of the solenoid of FIG. 3.

The embodiment of a tubular solenoid as shown in FIG. 3 is based substantially upon the concept and teachings of the embodiment of FIG. 2, but offers certain additional cost and structural advantages. A tubular drawn case 50 is also employed, corresponding substantially to the case 20, and in this embodiment is provided with a relatively deeper inwardly extending integral pole portion 52 at the closed end thereof. A bobbin 55 is injection molded of plastic material and is received within the case 50 with an energizing coil 56 wound thereon between the radial end walls 57 and 58. As shown in FIG. 3, an inner portion of the bobbin 55 is telescoped over the outer surface of the inwardly extending pole portion 52. As in the case of the bobbin 25, the bobbin 55 has an integral relatively thin spacer wall 60 which is positioned in conforming and abutting relation with the inwardly extending pole portion 52 of the case 50.

The bobbin 55 also has a forward extension portion 59 which defines an axial cylindrical opening for slidably receiving a plunger 35, and as in the embodiment of FIG. 2, the wall 60 forms a stop or abutment surface for the plunger 35, thus accurately spacing the plunger from direct contact with the pole portion 52.

The rear wall of the case 50 is apertured to receive an integral terminal extension portion 66 corresponding substantially to the terminal extension portion 36 of the coil form 25 of FIG. 2, and described in greater particularity with respect to FIGS. 5–8 of the drawings. The forward extension portion 59 is provided with external mounting threads 67. A washer or ring 70 of magnetic material is threaded onto the extension portion 59 into abutment with the wall 58 and is provided with an outwardly opening annular semi-circular recess 71. The terminal or forward end 72 of the case 50 is crimped within the recess 71 to complete the assembly. The ring 70 provides a flux path from the case 50 to the plunger 35.

Figure 9:
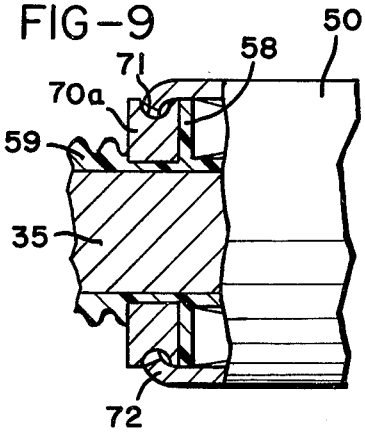
FIG. 9 is a fragmentary section of a modification of the solenoid of FIG. 3, and FIGS. 10 and 10A are further fragmentary sections showing further modifications of the solenoid of FIG. 3.

FIG. 9 shows a modification of the means for mounting a front soft iron ring to provide a flux path from the case to the plunger 35. In FIG. 9, the ring 70*a* is molded in place directly onto the front extension portion 59 of the bobbin 55 in abutment with the front coil wall 58. The arrangement of FIG. 9 may be preferred where higher production volumes justify the additional cost of insert molding the ring 70*a* directly onto the bobbin 55. Also, a split ring may be used and the two halves assembled on the bobbin in the bobbin groove as shown. When the case is crimped in place, the ring halves will be captured on the bobbin.

Figure 10:
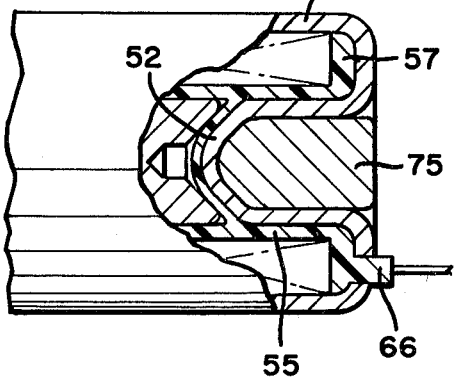
Figure 10A:
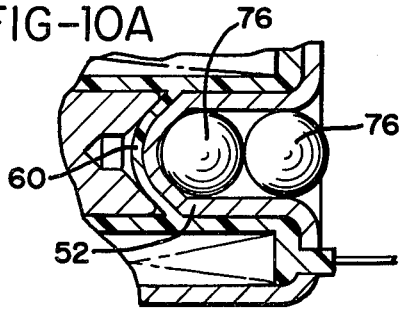

In FIGS. 10 and 10A modifications are shown by means of which the attractive force of the solenoid of FIG. 3 may be substantially increased where desired. In FIG. 10 a simple soft iron plug or insert 75 with a conforming nose portion is pressed as an interference fit into the external hollow space formed by the inwardly extending pole portion 52, as shown. The plug 75 has the effect of increasing the flux-carrying capacity across the gap defined by the wall 60 of the bobbin 55. Substantially the same effect may be achieved, at still lower cost, in which the flux carrying plug means comprises one or more mild steel balls 76 pressed into the hollow external cavity defined by the pole portion 52, as shown in FIG. 10A.

Figure 5:
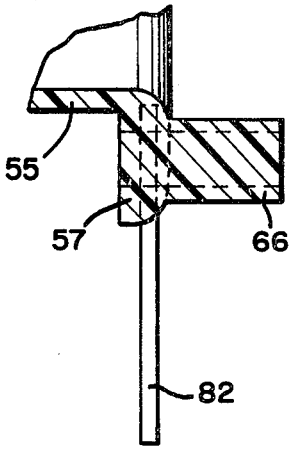
FIG. 5 is an enlarged fragmentary detail showing the manner in which the terminals of the electric coil are molded or inserted into the bobbin, taken generally along the line 5—5 of FIG. 6.
Figure 6:
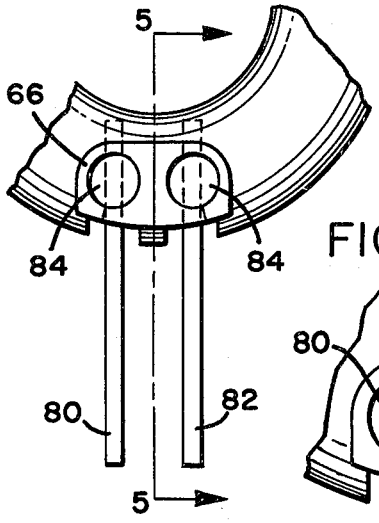
FIG. 6 is a fragmentary end view of the bobbin showing the terminals in place.
Figure 7:
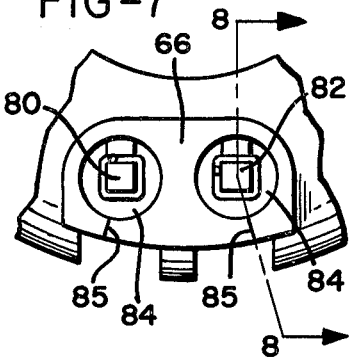
FIG. 7 is a view similar to FIG. 6 showing the manner in which the terminals are brought out through openings formed in the bobbin extension.
Figure 8:
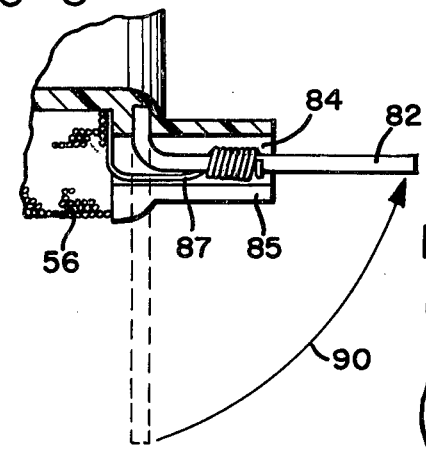
FIG. 8 is a fragmentary section similar to FIG. 5, taken along the line 8—8 of FIG. 7, showing one of the terminals in elevation with the coil wires attached thereto.

The views of FIGS. 5–8 illustrate the preferred arrangement by which the electric terminals are molded or inserted and supported directly into the bobbin walls. In the illustration of FIGS. 5–8, the bobbin 55 of FIG. 3 is shown, but it should be understood that the same terminal arrangement is preferably used in connection with the bobbin 25 of FIG. 2. A pair of terminals 80 and 82 have inner ends which are molded or driven into the wall 57 in parallel spaced-apart relation, as shown in FIGS. 5 and 6. The terminal extension 66 is formed with a pair of axial apertures 84 to receive the terminals 80 and 82. The outer wall of the extension 66 is cut as shown by the slits 85 in FIG. 7 which intersect the apertures. The terminals 80 and 82 are suitably implanted into the wall 57, and the leads 84 forming the magnetic wire of the coil 56 are suitably wrapped about the respective terminals 80 and 82 and soldered in place. These terminals are then bent outwardly in the direction shown by the arrow 90 in FIG. 8, and are snapped in place into the apertures 84 through the slits 85. The plastic material defining the extension 66 then recloses and electrically isolates the terminal leads 80 and 82 from the adjacent wall of the case 50. By forming the terminals in place and bringing the same through a terminal extension formed as an integral part of the bobbin, the necessity for wiring in and handling the conventional flexible coil leads is eliminated, thus further reducing costs and simplifying the insertion of the bobbin and coil within the drawn case.

While the forms of apparatus herein described constitute preferred embodiments of the invention, it is to be understood that the invention is not limited to these precise forms of apparatus, and that changes may be made therein without departing from the scope of the invention.

What is claimed is:

1. A tubular solenoid comprising:

a drawn cylindrical case having an open end and a closed end, means at said closed end thereof defining an integral inwardly extending pole portion;

a bobbin received in said case having an energizing coil thereon;

means in said bobbin defining an axial plunger receiving opening, a plunger received in said opening for reciprocal movement therein, means in said bobbin defining an integral wall positioned in abutting relation to the inside surface of said pole portion forming a stop surface for said plunger and spacing said plunger from said pole portion, said bobbin further having an integral forward portion extending axially of said case through said open end thereof, and solenoid mounting means associated with said axially extending forward portion.

2. The solenoid of claim 1 in which said mounting means includes a hollow sheet metal bushing received over said axially extending portion having an annular flange joined with said case at the open end thereof, and a sheet metal nut threaded on said bushing.

3. The solenoid of claim 1, in which said mounting means comprises means on said forwardly extending portion defining threads formed directly therein.

4. The solenoid of claim 1 in which said inwardly extending pole portion defines an outwardly-opening recess, and flux carrying plug means inserted in said recess to increase the flux-carrying capacity of said pole portion.

5. The solenoid of claim 4 in which said plug means comprises a soft iron plug.

6. The solenoid of claim 4 in which said plug means comprises at least one mild steel ball.

7. A tubular solenoid comprising:

a drawn cylindrical case having an open end and a closed end, means at said closed end thereof defining an integral inwardly extending pole portion, a bobbin received in said case having an energizing coil thereon, means in said bobbin defining an axial plunger receiving opening, a plunger received in said opening for reciprocal movement therein, and means in said bobbin defining an integral wall positioned in abutting relation to the inside surface of said pole portion forming a stop surface for said plunger and spacing said plunger from said pole portion.

8. The solenoid of claim 7 in which said inwardly extending pole portion defines an outwardly-opening recess and flux carrying plug means inserted in said recess to increase the flux-carrying capacity of said pole portion.

9. A tubular solenoid comprising:

a metal case having means defining an open end and a closed end, means in said closed end defining a terminal aperture and further defining an integral pole portion, a bobbin received in said case having a front wall, a rear wall and an energizing coil thereon between said walls, means in said bobbin defining an axial plunger receiving opening, means in said bobbin back wall defining an integral plunger stop positioned in abutting relation to the inside surface of said pole portion, means in said bobbin back wall further defining an axial terminal extension portion formed as an integral part thereof received in said terminal aperture, and a pair of coil terminals having one of their ends thereof received in said back wall and extending through said extension portion, said extension portion isolating said terminals from each other and from said case.

* * * * *